United States Patent [19]

Collins, Jr.

[11] Patent Number: 4,721,462

[45] Date of Patent: Jan. 26, 1988

[54] ACTIVE HOLD-DOWN FOR HEAT TREATING

[75] Inventor: Earl R. Collins, Jr., La Canada, Calif.

[73] Assignee: The United States of America as represented by the Administrator of the National Aeronautics and Space Administration, Washington, D.C.

[21] Appl. No.: 921,573

[22] Filed: Oct. 21, 1986

[51] Int. Cl.[4] ..... F27D 5/00; B25B 11/00

[52] U.S. Cl. ..... 432/253; 269/21; 248/362

[58] Field of Search ..... 432/253, 5, 9, 10, 162, 432/226; 34/239; 248/362, 363; 269/21

[56] References Cited

U.S. PATENT DOCUMENTS

| | | | |
|---|---|---|---|
| 1,945,481 | 1/1934 | Dilkes | 248/39 |
| 2,694,337 | 11/1954 | Anander | 88/24 |
| 2,782,574 | 2/1957 | Copold | 51/235 |
| 2,814,233 | 11/1957 | Anander | 88/24 |
| 2,895,706 | 7/1959 | Blatherwick | 248/363 |
| 3,107,078 | 10/1963 | Schutt | 248/363 |
| 3,180,608 | 4/1965 | Fischer | 248/363 |
| 4,448,404 | 5/1984 | Ogawa et al. | 269/21 |
| 4,468,017 | 8/1984 | Pavone | 269/21 |

FOREIGN PATENT DOCUMENTS

| | | | |
|---|---|---|---|
| 0160439 | 12/1980 | Japan | 269/21 |
| 0048107 | 7/1981 | Japan | 269/21 |
| 0127935 | 7/1985 | Japan | 269/21 |
| 0150929 | 8/1985 | Japan | 269/21 |

*Primary Examiner*—Harry Tanner

*Attorney, Agent, or Firm*—Paul F. McCaul; John R. Manning; Thomas H. Jones

[57] ABSTRACT

A vacuum hold-down is described, for holding a thin film workpiece while it undergoes large temperature changes and corresponding dimensional changes, which permits creep of the workpiece to avoid damage thereto while still holding it on a support surface. The support surface has a multiplicity of holes arranged in a plurality of zones. The vacuum is repeatedly interrupted at the holes lying at different zones while it continues to be applied at the other zones, to permit creep of the workpiece at a zone when vacuum is not applied thereto.

10 Claims, 4 Drawing Figures

FIG. 1
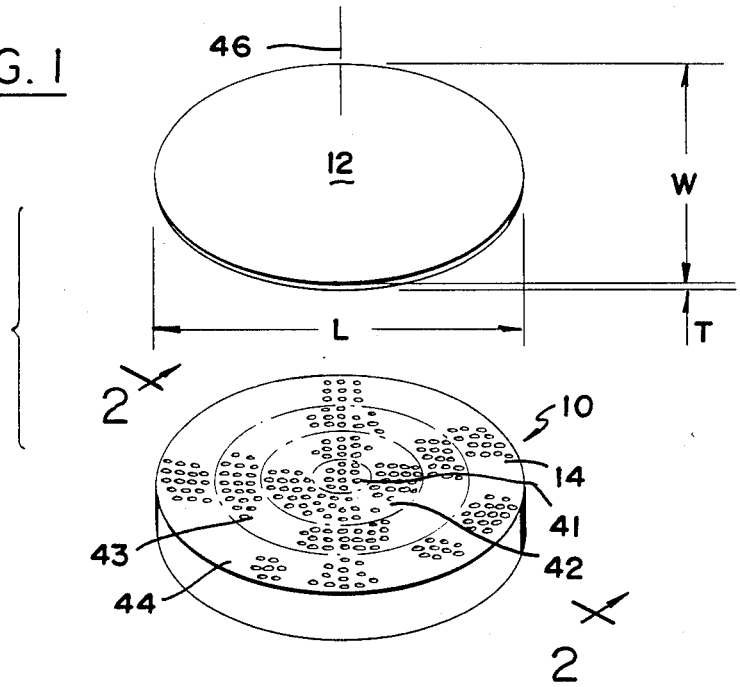
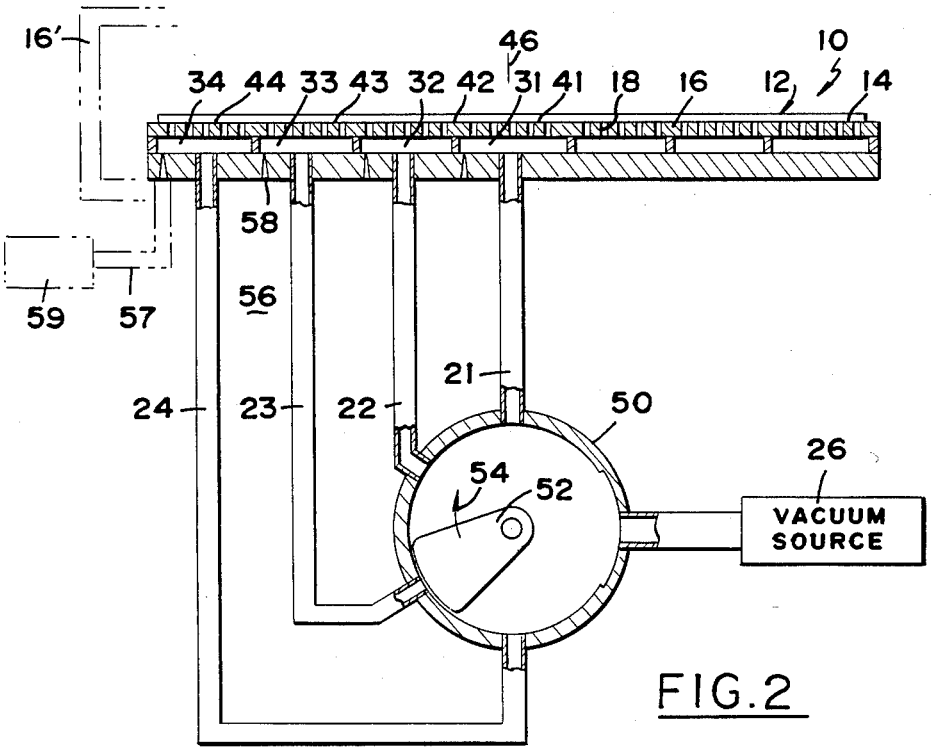
FIG. 2

ACTIVE HOLD-DOWN FOR HEAT TREATING

ORIGIN OF INVENTION

The invention described herein was made in the performance of work under a NASA contract, and is subject to the provisions of Public Law 96-517 (35 USC 202) in which the Contractor has elected not to retain title.

BACKGROUND OF THE INVENTION

Thin sheets, called tapes, that are used in manufacturing oxygen membranes, capacitors, etc., are formed by squeegeeing a slurry into a thin film, allowing the film to dry to a rubbery condition, and then baking the film in an oven wherein it shrinks and achieves a brittle consistency. During baking, the film must be held down against a flat or other surface to which the final sheet is to conform, to avoid curling of the sheet into a brittle unwanted shape. A vacuum hold-down can be used to hold the sheet while it is baked. However, it is found that the sheet is subject to cracking as it shrinks, due to the vacuum holding all portions of the original sheet in their original positions. A device for holding thin workpieces against a surface, which enabled the workpieces to change dimensions while they continued to be held closely against the surface, would be of value in the forming of the sheets described above as well as other thin workpieces that had to be heat treated.

SUMMARY OF THE INVENTION

In accordance with one embodiment of the present invention, a hold-down device is provided for holding a thin workpiece while it undergoes dimensional changes, which permits creep of the workpiece to enable dimensional change thereof without deformity while continuing to hold the workpiece closely against a support surface. The wall which forms the support surface has a mulitiplicity of holes arranged in a plurality of zones. A means for applying vacuum to the holes to hold the workpiece against the surface, is constructed to repeatedly stop applying the vacuum to different of the zones at different times while continuing to apply the vacuum to other zones. At the time the vacuum is interrupted at the zone, the portion of the workpiece at that zone can creep along the support surface, and yet that zone of the workpiece is held substantially to the support surface by the vacuum applied to adjacent zones.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a vacuum hold-down constructed in accordance with one embodiment of the present invention.

FIG. 2 is a view taken on the line 2—2 of FIG. 1.

DESCRIPTION OF THE PREFERRED EMBODIMENTS

Figure 3:
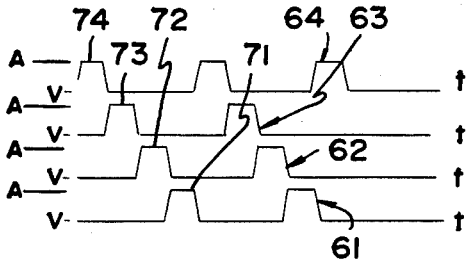
FIG. 3 includes a series of graphs showing the variation of pressure with time at each of the zones of the apparatus of FIG. 2.

FIGS. 1 and 2 illustrate a vacuum hold-down device 10 which can hold a thin workpiece 12 against a support surface 14 while the workpiece undergoes a change in dimensions. Such change is usually a result of heat treating of the workpiece, as by heating and cooling it within an oven 15. The device includes an upper wall 16 which forms the support surface, and a multiplicity of holes 18 in the upper wall for applying a vacuum to the workpiece resting on the support surface to hold the workpiece tightly against the surface. A group of conduits 21–24 couple a vacuum source 26 to corresponding plenums 31–34 that lead to the holes to apply vacuums to the holes.

In prior art vacuum hold-downs, the vacuum was applied continuously while the workpiece was heat treated. Where the workpiece undergoes a significant change in lateral dimensions L and W (which are perpendicular to the thickness dimension T of the thin workpiece) while its temperature changes or a solvent of the like is driven from the workpiece, damage can occur to the workpiece. If the workpiece contracts, then tears can arise in the workpiece as the different portions draw apart, while if the workpiece expands, localized areas may develop wrinkles.

In one manufacturing operation for producing thin sheets, often referred to as tapes, for use in manufacturing oxygen membranes, dielectrics for capacitors, etc., a slurry is laid in a thin sheet and dried. The dried sheet has the consistency of rubber, and is then placed on a surface where it is heat treated in an oven, where it becomes brittle. During such heat treating, the tape or membrane shrinks. It is necessary to hold down the membrane during heat treating, or else it will curl away from the surface and will not have a flat or predetermined curved shape which is required in a particular application. A vacuum hold-down device is effective in holding the membrane to a predetermined configuration such as in a flat sheet, but it was found that the sheet would develop tears as it tended to shrink while being firmly held by a vacuum against a support surface.

In accordance with the present invention, creep of the workpiece 12 is permitted while it continues to be held to the support surface 14 by vacuum. The multiplicity of holes 18 in the upper wall 16 of the device is arranged in a plurality of zones. In FIGS. 1 and 2, the holes are arranged in four zones 41–44 that are in the form of circles or rings at different spacings from a center or axis 46 of the device. The holes in each zone are coupled to a corresponding one of the plenums 31–34 by a corresponding one of the four conduits 21–24. Each of the conduits is coupled through a valve means or device 50 to the vacuum source 26. The valve device 50 operates to interrupt or relieve the vacuum at the holes in at least some of the zones, so the pressure under the workpiece in each such relieved zone is substantially equal to atomospheric pressure, or ambient pressure where the furnace is at other than atmospheric pressure. Such vacuum relief allows the portion of the workpiece in the relieved zone to creep, either radially inwardly or outwardly.

By alternating the vacuum relieved zones among most or all of the zones, such creeping can progress across substantially the entire area of the thin workpiece, to allow it to change dimensions. The fact that the vacuum continues to be applied to some of the zone while one or more of the others is relieved, results in the workpiece being held down to the surface at a location near the relieved zone, so that the workpiece cannot curl or bend more than a very small distance away from the support surface at the relieved zone. Then, when the vacuum is reapplied to the previously relieved zone, the workpiece is again held down to the support surface at that zone. By repeatedly altering the relieved zone, creeping can continue throughout heat treating, to produce a workpiece whose shape closely conforms to that of the support surface, but which can be free of tears and wrinkles.

In FIG. 2, the valve 50 includes a blocking member 52 that rotates in a direction 54, to relieve the pressure in conduit 24, then conduit 23, then conduit 22, and finally conduit 21. Thus, the relief zone progresses radially inwardly to permit the workpiece to shrink radially inwardly towards the axis 46. It may be noted that since the centermost zone 41 is at the center, it may not be necessary to repeatedly relieve the vacuum thereat. When the valve member 52 is blocking a particular conduit such as 23, air from the outside 56 is allowed to leak into the plenum 33 through a small leakage hole 58 leading from the environment at the same pressure as the area above the workpiece, into the plenum 33. It is possible to apply a slight positive pressure to the plenum such as 33 when the vacuum applied to the conduit such as 23 is relieved, to help break that zone of the workpiece away from the support surface to facilitate its creeping. This can be accomplished by coupling each bleed hole through a conduit 57 to a source 59 of air at a pressure slightly higher than the ambient pressure above the workpiece.

FIG. 3 includes graphs 61–64 which indicate the variation in pressure with time at each of the groups of holes at each zone 41–44. The pressure in each zone varies between a pressure A equal to ambient pressure, and a pressure V equal to a vacuum pressure. It can be seen that the removal of vacuum as indicated at 71–74 progresses radially inwardly along the zones and then repeats. The period during which the vacuum is relieved throughout all zones whose vacuum is to be relieved, shoulder occur during a change in dimensions of the unrestrained workpiece of no more than 1%. This is because most materials, other than elastomers, tend to become permanently deformed (and may tear or wrinkle) when their dimensions change more than on the order of 1%. The period during which the vacuum is no longer applied to each zone should be long enough so that the pressure in the plenum under the holes in the zone can fall to substantially ambient pressure (or rise to slightly above ambient pressure where positive pressure is applied). In one device of the type shown in FIG. 2, the valve member 52 makes one rotation about every four seconds, so that during a period of several minutes while the tape is heat treated, there are many vacuum relief cycles during which the workpiece can gradually creep along the support surface as its dimensions change.

Figure 4:
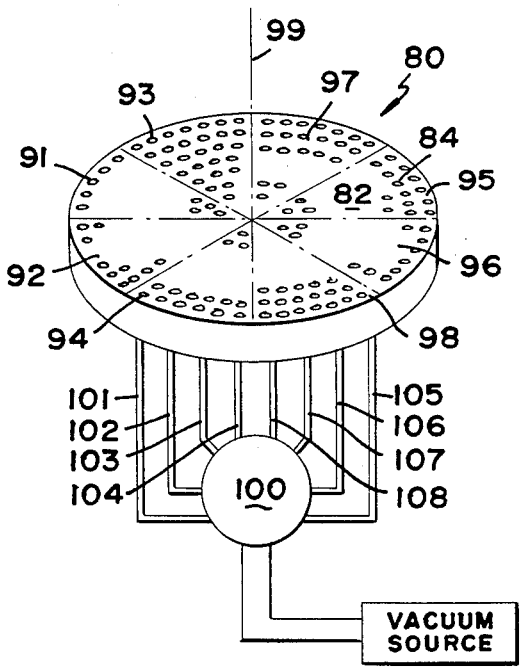
FIG. 4 is a perspective view of another hold-down device of the invention.

FIG. 4 illustrates another vacuum hold-down device 80 which has a wall 82 with holes 84 arranged in eight zones 91–98 that are substantially pie-shaped and which are angularly spaced about the axis 99 of the support surface. A value 100 connects a vacuum source through each of eight conduits 101–108 to the eight zones. The zone to which ambient or slightly above ambient pressure is applied, rotates around the axis 99. Thus, each pie-shaped area of the workpiece can creep inwardly or outwardly at one time. It is possible to have some holes near the intersection of two zones lie in both zones to faciltate creep.

Thus, the invention provides a vacuum hold-down device which permits a thin workpiece to undergo a dimensional change in its width and/or length, especially as the temperature of the workpiece changes, to avoid tearing or wrinkling of the workpiece. This is accomplished by repeatly relieving the vacuum at different zones at different times during the change in dimensions of the workpiece.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A vacuum hold down apparatus for holding a thin workpiece comprising:

a wall which forms a support surface defining a plurality of zones, said wall having a plurality of holes with at least one hole in each of said zone;

means for applying a vacuum to said holes to hold a workpiece to said surface, said applying means being constructed to repeatedly stop applying said vacuum to different of said zones at different times while continuing to apply said vacuum to others of said zones such that a zone where a vacuum is not applied may be interposed between zones where vacuum is aplied;

whereby the workpiece may change dimension by undergoing movement relative to the support surface in a zone where vacuum is not applied while workpiece is held to the support surface at zones where vacuum is applied.

2. The apparatus described in claim 1 wherein:

said zones include a middle zone and a plurality of outer zones radially spaced by different distances from said inner zone;

said applying means stops applying said vacuum to zones at progressively smaller distances from said middle zone at successive times, whereby to enable the workpiece to the shrink by its radially outer portions creeping radially inwardly.

3. The apparatus described in claim 1 wherein:

said zones are angularly spaced from one another about an axis extending perpendicular to said support surface;

said applying means stops applying said vacuum to one of said zones but not to adjacent zones on either side of said one zone.

4. The apparatus described in claim 1 wherein:

said applying means is constructed to apply a pressure greater than the ambient pressure existing immediately above a workpiece lying on said surface, to a zone at a time when said applying means stops applying said vacuum to that zone.

5. Apparatus for holding a thin film workpiece while heat treating it comprising;

a wall forming a support surface for supporting said thin workpiece, said wall having a multlipilcity of holes located in a plurality of zones leading to said surface;

a plurality of vacuum conduits, leading to the holes in different ones of said zones;

a vacuum source;

value means complying said vacuum source to said conduits to selectively apply said vacuum source to each conduit;

means coupled to said valve means for applying said vacuum source to only certain of said conduits but not to at least one other conduit during a period when the temperature of said thin workpiece changes such that vacuum is applied to certain of said zones but vacuum is not applied to at least one zone which may be interposed between zones where vacuum is applied;

and said means coupled to said valve means functioning to alternate the conduits to which said vacuum source is not applied during said period;

whereby the thin film workpiece may change dimension by undergoing movement relative to the support surface in a zone where vacuum is not applied while the workpiece is held to the support surface at zones where vacuum is applied.

6. The apparatus described in claim 5 including:

means for applying a pressure greater than the ambient pressure existing immediately above a workpiece lying on said surface, to the holes in a zone, during a time when a vacuum is not applied to a conduit leading to that zone.

7. A method for holding a thin film workingpiece to prevent cracking of the workpiece during a change in a lateral dimension of the workpiece of as much as in excess of one percent, said method comprising:

placing said thin film workpiece on a surface that has a multiplicity of holes arranged in a plurality of zones;

applying a vacuum to holes in said zones to cause the workpiece to adhere to said surface at said holes;

repeatedly stopping the application of a vacuum to the holes in different of said zones while continuing to apply vacuum to the holes in others of said zones such that a zone where vacuum is not applied may be interposed between zones where vacuum is applied;

whereby the workpiece may change dimension by undergoing movement relative to the support surface in a zone where vacuum is not applied while the workpiece is held to the support surface at zones where vacuum is applied.

8. The method described in claim 7 including:

applying a pressure greater than ambient pressure to at least certain of said holes at a time when a vacuum is not applied to said certain holes but is applied to other ones of said holes.

9. The method described in claim 7 wherein:

said zones include a plurality of zones at different distances from an imaginary central axis which etends perpendicular to the middle of said support surface;

and said steps of applying and stopping include progressively terminating and then reapplying the vacuum in zones progressively spaced from said axis.

10. The method described in claim 7 wherein:

an imaginary central axis extends perpendicular to the middle of said support surface; and said steps of applying and stopping include terminating and reapplying the vacuum to zones angularly spaced about said axis.

* * * * *